United States Patent [19]

Wardwell

[11] Patent Number: 5,069,449

[45] Date of Patent: Dec. 3, 1991

[54] STRAP DEVICE FOR INCREASING LUNG CAPACITY

[76] Inventor: Mary M. Wardwell, 120 Lakeshore Dr. - T-35, N. Palm Beach, Fla. 33408

[21] Appl. No.: 470,578

[22] Filed: Jan. 26, 1990

[51] Int. Cl.[5] ..... A63B 21/055

[52] U.S. Cl. ..... 272/139; 272/142; 272/125; 128/78; 128/94

[58] Field of Search ..... 272/93, 94, 99, 116, 272/119, 135, 137, 139, 142, 143, 900, 125, 126; 128/78, 99.1, 94, 100.1, 105.1, 869, 870, 874, 875

[56] References Cited

U.S. PATENT DOCUMENTS

| | | | |
|---|---|---|---|
| 945,359 | 1/1910 | Adams | 128/78 |
| 1,075,348 | 10/1913 | Fritsch | 128/78 |
| 1,402,179 | 1/1922 | Piscitelli | 272/139 |
| 1,539,569 | 5/1925 | Hubert | 272/142 |
| 1,663,641 | 1/1927 | Smallwood | 272/139 |
| 2,586,658 | 2/1952 | Hormann | 128/78 |
| 3,108,589 | 10/1963 | Staggs | 128/94 |
| 3,182,655 | 5/1965 | Nelkin | 128/78 |
| 3,404,680 | 10/1968 | Gutman et al. | 128/94 |
| 3,415,515 | 12/1968 | Otto | 272/142 X |
| 3,554,194 | 1/1971 | Johnson | 128/94 |
| 4,198,964 | 4/1980 | Honneffer | 128/94 |
| 4,251,071 | 2/1981 | Norton | 272/143 X |
| 4,257,591 | 3/1981 | Evans, Jr. | 272/143 X |
| 4,335,875 | 6/1982 | Elkin | 272/126 X |
| 4,540,173 | 9/1985 | Hopkins, Jr. | 272/139 |
| 4,762,318 | 8/1988 | Phillips et al. | 272/137 |

FOREIGN PATENT DOCUMENTS

| | | | |
|---|---|---|---|
| 0494526 | 6/1953 | Canada | 272/57 |
| 2211551 | 9/1973 | Fed. Rep. of Germany | 272/119 |
| 0563315 | 12/1923 | France | 272/126 |

OTHER PUBLICATIONS

Websters New World Dictionary, Third College Edition; Copyright 1988, p. 1142.

*Primary Examiner*—Richard J. Apley
*Assistant Examiner*—L. Thomas
*Attorney, Agent, or Firm*—Jack N. McCarthy

[57] ABSTRACT

The strap device comprises an elongated and resilient strap with movable contour shoulder pads of a shock absorbing material with the overall length of strap being adjustable. The hand holds located at each end of the length of strap are also adjustable. The strap device is uniquely placed on the upper body to employ a rhythmic movement of exertion upon inhaling and relaxation when exhaling. This uniform motion of exertion and relaxation of the uniquely placed strap device on the upper body opens up the air passages and improves breathing, allowing a greater amount of air to be inhaled and exhaled.

8 Claims, 3 Drawing Sheets

STRAP DEVICE FOR INCREASING LUNG CAPACITY

DESCRIPTION

1. Technical Field

This invention relates to a strap device which opens airways to improve breathing. Additionally, the strap device provides a form of exercise, operating to avoid overexertion of the breathing of asthmatics or persons with similar lung conditions.

2. Background Art

Persons suffering from asthma or similar lung conditions face the delicate balance of exercise and medication to keep the air passages open and to maintain normal breathing. Extremes in exercise can overexert asthmatics or other persons similarly affected, triggering breathing difficulties.

Understandably, exercise is often recommended to enhance the general well being of asthmatics or persons with similar breathing difficulties. Olympic track star, Florence Griffith-Joyner, is a shining example of the coupling of modern bronchodilators and exercise in the control of asthma.

Two major areas of concerns for asthmatics or persons with certain breathing difficulties are bronchodilation and exercise.

Modern bronchodilators generally deliver medications with the use of hand held inhalers and/or aerosol treatments assisted by compressed air units without the benefit of exercise as provided by this invention.

DISCLOSURE OF INVENTION

A primary object of this invention is to provide a strap device which aids chest movement to open airways and to improve breathing by allowing more air to be inhaled and exhaled.

Another object of this invention is to provide exercise without overexertion that triggers breathing difficulties for asthmatics or other persons similarly affected.

A further object of this invention is to provide the application of a strap device prior to using hand held inhalers or in conjunction with aerosol treatments assisted by compressed air units to force medications even deeper into the lungs to further open air passages and to establish more normal breathing.

Another object of this invention is to provide a strap device that operates to loosen phlegm which is more readily expelled from the respiratory system and thus open airways.

Another object of this invention is to provide a tension-relaxation system that occurs as a result of the exertion-relaxation movement of the upper body.

A further object of this invention is to provide an adjustable strap which will operate to serve a range of users within a size category.

Another object of this invention is to provide a contour pad on the strap for each shoulder to control the location of the strap on the ends of the shoulders and maintain it in a proper position; this sets the control line of exertion and relaxation across the shoulders. The contour construction of each pad on the strap allows the cupped location of pads at the end of each shoulder to reduce a cutting action by the strap against the body.

The present invention provides a rhythmic movement of exertion and relaxation of the upper body to open airways and improve breathing, thus allowing a greater amount of air to be inhaled and exhaled. The exertion motion of the strap device operates upon inhaling and is designed to improve breathing by lifting the rib cage, expanding the chest and diaphragm, and extending the abdominal region. This uniform movement of exertion causes the intercostal muscles to expand the lungs from above, downward, and from side to side. The relaxation motion of the strap device occurs upon exhaling through the mouth with an audible sound.

Furthermore, the strap device may be employed prior to using inhalers, or in conjunction with aerosol treatments, to force medications even deeper into the lungs to further open airways and to establish more normal breathing.

Finally, the strap device provides exercise and movement that avoids overexertion, loosens phlegm within the respiratory system, and also serves as a tension-relaxation system.

Other objects and features of the invention will become apparent in the detailed description of the invention, claims, and the following drawings.

DETAILED DESCRIPTION OF THE INVENTION

The present invention is a strap device 1 to be uniquely placed on the upper body while standing or sitting. The invention may be used independently, or prior to using hand held inhalers, or in conjunction with aerosol treatments assisted by compressed air units. In all instances, the invention lifts the rib cage, expands the chest and diaphragm, and extends the abdominal region. The rhythmic movement of exertion and relaxation of this invention improves breathing and allows a greater amount of air to be inhaled and exhaled.

Figures 1, 1A, 1B:
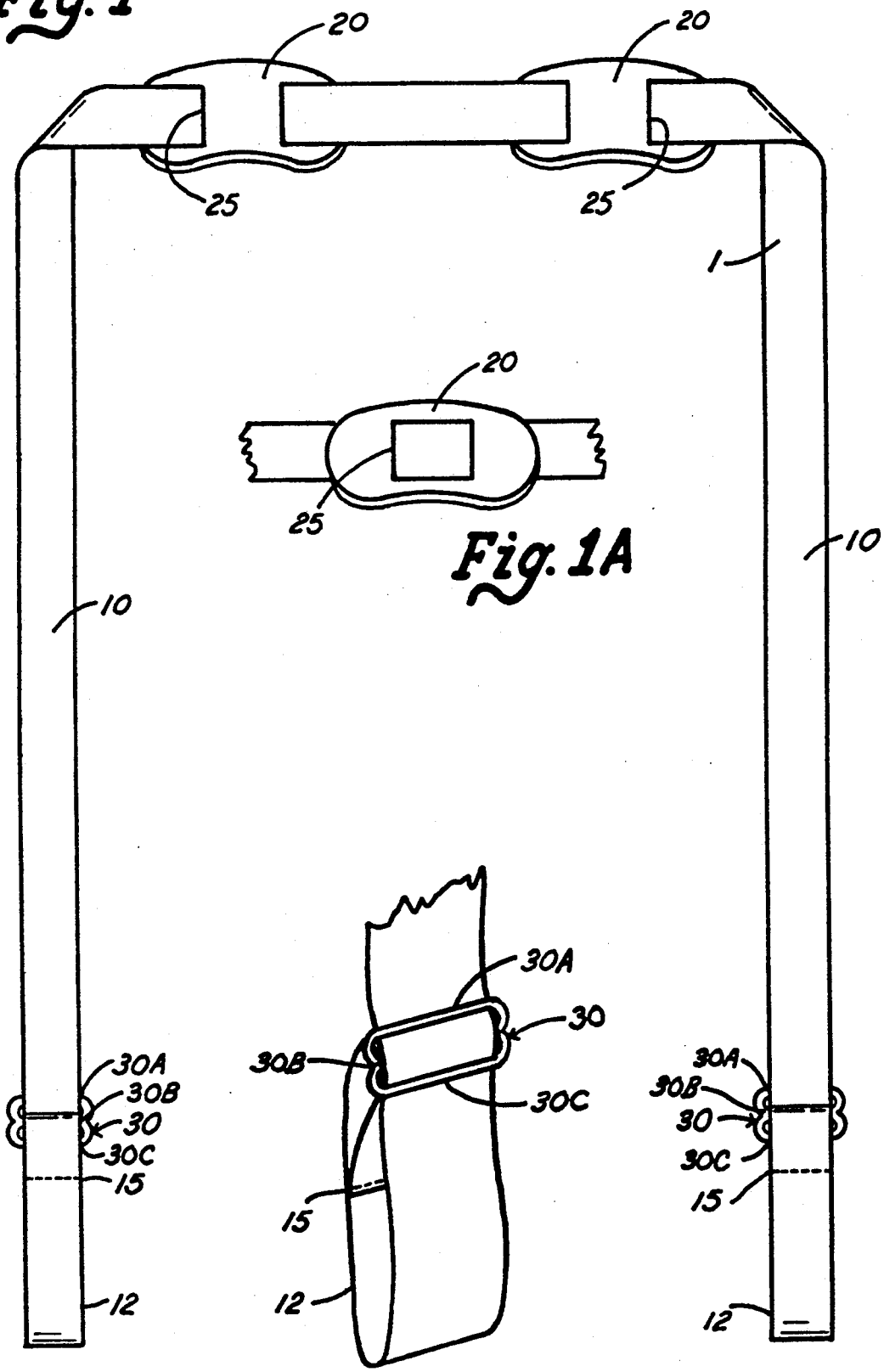
FIG. 1 is a view showing the present invention.
FIG. 1A is a plan view showing the shoulder pad as viewed from the reverse side.
FIG. 1B is a plan view showing the hand hold as viewed from the reverse side.

Referring to the view of FIG. 1, one form of the strap device 1 is shown. As illustrated, a strap 10 is shown in FIG. 1 which is made of a resilient material having various widths, lengths, and resiliency in order to withstand various degrees of exertion by the user. Strap 10 can be constructed of woven nylon or similar fiber of varying resiliency.

FIGS. 1 and 1A show movable contour shoulder pads 20 which are comprised of a shock absorbing material, such as foam rubber. Shoulder pads 20 may be constructed of varying thicknesses, lengths, and widths. FIGS. 1 and 1A reveal that slits 25 on the shoulder pads 20 allow the pads 20 to be appropriately located on the strap 10 to accommodate a variety of users. Further, the strap 10, when placed through the slits 25 of a pad 20, places the pad in a cupped position to be placed over the end of a shoulder. Slits 25 in a shoulder pad 20 permit varying degrees of pressure on the end of a shoulder as the strap 10 passes above and below the shoulder pad 20, while the pad resists movement of the strap away from the end of the shoulder. Strap 10, passing through slits 25 underneath shoulder pads 20 directly contacts the shoulder, allowing pressure to be increased at or near the top of the arms at the end of the shoulders. Strap 10, passing through slits 25 over the ends of a shoulder pad 20, distributes pressure through the shoulder pad and keeps the pad securely in place while reducing a cutting action on the body at those points. Slits 25 in shoulder pads 20 provide and assist in the smooth rhythm of the invention.

FIGS. 1 and 1B reveal that the strap 10 is arranged to form hand holds 12 at its ends which are adjustable to various hand widths by metal or nonmetal sliders 30. Sliders 30 also allow the overall length of the strap 10 to be modified to varying sizes of users. Other desired hand hold means 12 can be used, along with other desired strap 10 length adjusting means.

Sliders 30 are each formed having three (3) crossbars 30A, 30B, and 30C, substantially in the same plane and being separated from each other to permit the passage of several thicknesses of the strap 10. A curved portion connects each outside crossbar 30A and 30C at its ends to the center crossbar 30B.

In this construction, each end of strap 10 is connected to a slider 30 by being passed between crossbars 30A and 30B, and then between crossbars 30B and 30C, and then doubled back and passed around the center crossbar 30B and sewn to itself by stitching 15. This forms hand holds 12 and provides length adjustment of strap 10. It can be seen that the slider 30 and the ends of strap 10 sewn thereto can be moved "up" or "down" in FIGS. 1 and 1B on strap 10 to change the effective length of strap 10. As stated before, other means to adjust the length of the strap 10 can be used.

Figure 2:
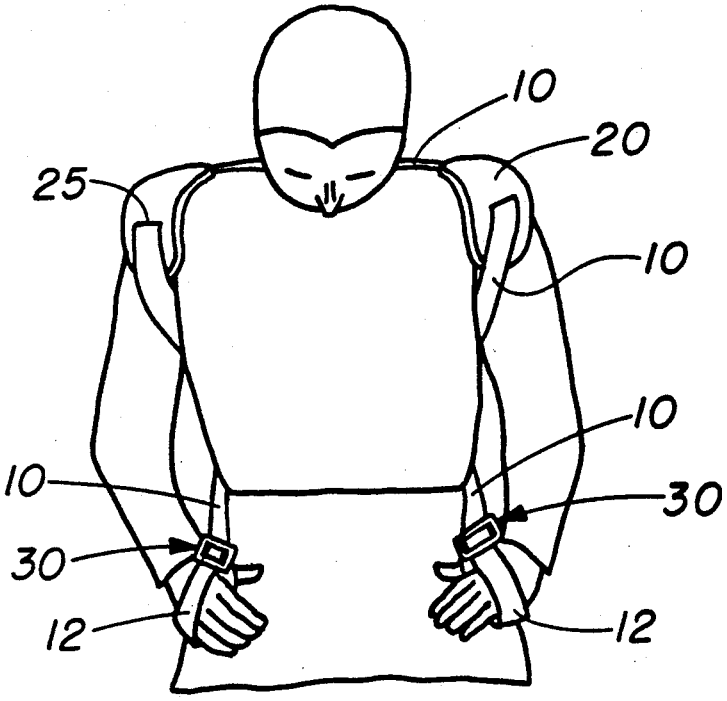
FIG. 2 is a plan front view showing the invention manipulated by the user in the Relaxation Position.
Figure 2A:
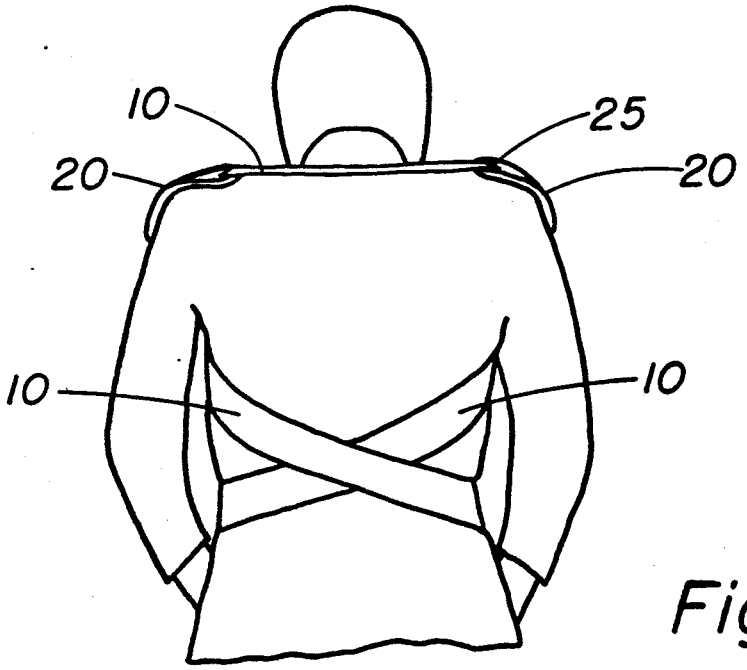
FIG. 2A is a plan back view of FIG. 2 showing the invention manipulated by the user in the Relaxation Position.

To use the strap device 1, a user places the strap 10 centrally below cervical vertebrae on the back of the shoulders. The strap 10 runs across the back of the shoulders. Shock absorbing contour movable shoulder pads 20 are securely positioned over the top of each arm at the end of the shoulders. Strap 10 passes under each arm at the shoulder joint and crosses on the back of the rib cage in the lower thoracic region. Each end of the strap 10 of strap device 1 is positioned outwardly toward the front of the body near the waist and is held in position by grasping the hand holds with the arms bent at the elbow. FIGS. 2 and 2A represent the strap device 1 positioned in the Relaxation Position with head, arms, chest, and shoulders dropped forwardly and downwardly.

Figure 3:
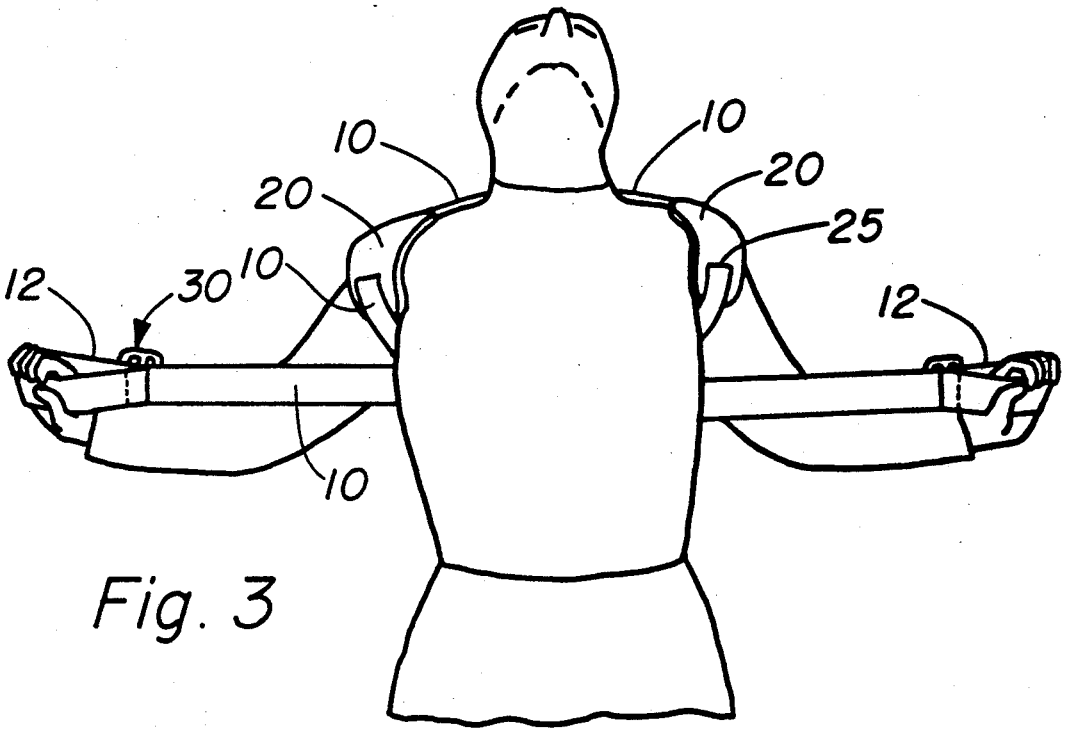
FIG. 3 is a plan front view showing the invention manipulated by the user in the Exertion Position.
Figure 3A:
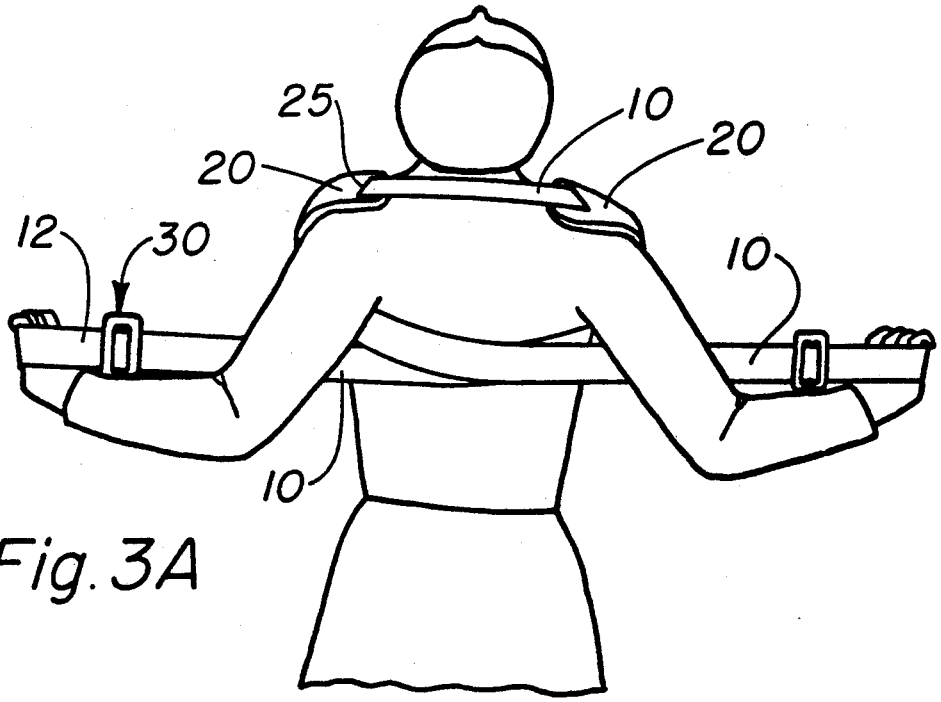
FIG. 3A is a plan back view of FIG. 3 showing the invention manipulated by the user in the Exertion Position.

FIGS. 3 and 3A represent the strap device 1 being manipulated by the user in the Exertion Position. FIG. 3 reveals the strap 10 being pulled with a steady movement of exertion by extension of the arms as the head is moved back to further open air passages while inhaling. As each hand hold 12 is pulled steadily outward, the strap 10 rises above elbow level, pulling the crossed strap 10 upwardly on the thoracic vertebrae to a level even with the upper arms or near scapulas. This position of exertion is held for about three seconds and then evenly released to the Relaxation Position shown in FIGS. 2 and 2A. This action is repeated in a steady rhythmic movement.

Upon the even release of the strap device 1, shown in FIGS. 2 and 2A, the breath is exhaled through the mouth with an audible sound. The head, shoulders, arms, and chest drop forward and down with the diaphragm and abdominal region drawn in and up. This relaxed position, as shown in FIGS. 2 and 2A, is held for about three seconds, followed by the Exertion Position shown in FIGS. 3 and 3A. This rhythmic movement should be repeated a minimum of five sequences. Maximum sequences may be determined by the tolerance of the user.

When the strap device 1 is used in conjunction with aerosol treatment administered with the aid of a compressed air unit, the Relaxation and Exertion Positions of FIGS. 2, 2A, 3, 3A, are employed as previously described. Additionally, the strap device 1 may be used prior to administering medication by hand held inhalers. In both instances, the use of the strap device 1 forces the medications deeper into the lungs and further improves breathing.

It will be obvious that the foregoing description and illustrations have been presented for the preferred form of this invention; however, it is not intended to limit the invention to the precise form disclosed. Furthermore, modifications and variations are possible in view of explanations presented. It is therefore intended that the scope of the invention be defined by the appended claims.

I claim:

1. A strap device for increasing lung capacity comprising an elongated strap having two ends, a hand hold means on each end of the strap, said strap being of such a length to extend across a user's back from the end of one shoulder to the end of the other shoulder with one end of said strap extending over said end of one shoulder from the back and under one arm from the front of the user across the back of the user with one hand hold means extending to the hand of the user on the user's other arm with said other arm being bent at the elbow, and the other end of said strap extending over said other end of the other shoulder from the back and under the other arm from the front of the user across the back of the user with the other hand hold means extending to the other hand of the user on the user's one arm with said one arm being bent at the elbow, said strap crossing over itself on the user's back, two shoulder pads are mounted on said strap, one shoulder pad extends from the back of the user to the front of the user and covers the end of one shoulder where it meets the upper arm, the other shoulder pad extends from the back of the user to the front of the user and covers the end of the other shoulder where it meets the upper arm.

2. A combination as set forth in claim 1 wherein said elongated strap has means for adjusting its length.

3. A combination as set forth in claim 1 wherein said elongated strap has means for adjusting the size of the hand hold means.

4. A combination as set forth in claim 1 wherein said elongated strap has means for adjusting its length and hand hold means simultaneously.

5. A combination as set forth in claim 1 wherein each pad is contoured to fit over the end of a shoulder where it meets the upper arm to locate said strap in position over the ends of the shoulders and maintains said strap there during use for increasing pressure at the ends of the shoulders expanding the chest.

6. A combination as set forth in claim 1 wherein said two shoulder pads are each independently slidably mounted on said strap to vary the distance between them for use.

7. A combination as set forth in claim 1 wherein said strap is woven nylon.

8. A strap device for increasing lung capacity comprising an elongated strap having two ends, a hand hold means on each end of the strap, said strap being of such a length to extend across a user's back from the end of one shoulder to the end of the other shoulder with one end of said strap extending over said end of one shoulder from the back and under one arm from the front of the user across the back of the user with one hand hold means extending to the hand of the user on the user's other arm with said other arm being bent at the elbow, and the other end of said strap extending over said other end of the other shoulder from the back and under the other arm from the front of the user across the back of the user with the other hand hold means extending to the other hand of the user on the user's one arm with said one arm being bent at the elbow, said strap crossing over itself on the user's back, two shoulder pad means are on said strap, one shoulder pad means extends from the back of the user to the front of the user and covers the end of one shoulder where it meets the upper arm, the other shoulder pad means extends from the back of the user to the front of the user and covers the end of the other shoulder where it meets the upper arm.

* * * * *